US005771776A

United States Patent [19]

Itoh

[11] Patent Number: 5,771,776

[45] Date of Patent: Jun. 30, 1998

[54] ENGINE PISTON AND METAL MOLD

[75] Inventor: Hideki Itoh, Kanagawa, Japan

[73] Assignee: Unisia Jecs Corporation, Atsugi, Japan

[21] Appl. No.: 840,848

[22] Filed: Apr. 17, 1997

[51] Int. Cl.[6] ..... F01P 1/04

[52] U.S. Cl. ..... 92/186; 123/41.35; 123/193.6

[58] Field of Search ..... 123/41.34, 41.35, 123/193.6; 92/186

[56] References Cited

U.S. PATENT DOCUMENTS

| | | | |
|---|---|---|---|
| 3,314,402 | 4/1967 | Tillack | 123/41.35 |
| 3,709,109 | 1/1973 | Howe | 123/41.35 |
| 3,738,335 | 6/1973 | Hoffmann | 123/41.35 |
| 4,206,726 | 6/1980 | Johnson, Jr. et al. | 123/41.35 |
| 4,331,107 | 5/1982 | Bruni | 123/41.35 |
| 4,907,545 | 3/1990 | Mills | 123/41.35 |
| 5,081,959 | 1/1992 | Akiyama | 123/41.35 |

FOREIGN PATENT DOCUMENTS

| | | | |
|---|---|---|---|
| 3-229956 | 10/1991 | Japan . | |
| 853382 | 11/1960 | United Kingdom | 123/41.35 |

*Primary Examiner*—Erick R. Solis
*Attorney, Agent, or Firm*—Foley & Lardner

[57] ABSTRACT

An engine piston comprises a piston main body including a piston head, and a cooling oil gallery in a form of a metal pipe integrally inserted in the piston head by a casting process of the main body. The oil gallery has an intermediate segment curved like an arc of a circle under the top surface of the piston, and first and second extensions extending from both ends of the intermediate segment, respectively, in the downward direction away from the top of the piston along the axis of the piston. This engine piston design facilitates the production process of the piston and reduces the manufacturing cost.

11 Claims, 4 Drawing Sheets

ENGINE PISTON AND METAL MOLD

BACKGROUND OF THE INVENTION

The present invention relates to engine pistons and metal molds for casting engine pistons. In particular, the present invention relates to an engine piston design including an oil gallery inserted, as an integral part, in a final casting of the piston, and to a mold assembly for such an engine piston design. The oil gallery in the form of a ring-shaped pipe circulates a cooling oil and thereby cools the piston in an internal combustion engine.

Japanese Patent Provisional Publication No. 3-229956 shows a conventional example. An engine piston of this example has an oil gallery of an annular metal pipe. Both open ends of the pipe are joined together and closed. In the casting process, the oil gallery is held by holding members positioned in an inner mold.

This conventional example, however, requires an operation for joining both ends of the oil gallery pipe by welding or staking (or caulking) to form a continuous oil passage, and this operation increases the manufacturing cost.

The holding members for locating the oil gallery in the inner mold further increase the cost. The operation for locating the oil gallery pipe through the holding members in the inner mold is troublesome.

This conventional example further requires an operation to form inlet and outlet holes for the cooling oil after the casting operation. This additional operation further increases the cost and complicates the process.

SUMMARY OF THE INVENTION

It is therefore an object of the present invention to provide engine piston design and mold assembly for facilitating the production process and reducing the production cost.

According to the present invention, an engine piston comprises a piston main body and a cooling oil pipe forming an oil gallery. The main body comprises a piston head defining a top surface of the piston. The cooling oil pipe is inserted in the piston head of the main body. In this engine piston, the cooling oil pipe includes at least an intermediate pipe segment and first and second extensions extending from the intermediate segment in a downward direction away from the top surface.

The cooling oil pipe serves as an oil gallery in the piston, and is made of metallic material having a good heat conductivity. For example, the cooling oil pipe is a pipe of copper, or a pipe of aluminum alloy.

The cooling oil pipe is hollow and open at the ends of the first and second extensions. One open end is used as an oil inlet hole and the other is an oil outlet hole. Thus, the oil pipe forms the continuous oil passage from one open end to the other open end.

This engine piston design does not require the operation for joining both end of the pipe, and does not require the operation for forming the oil inlet and outlet holes either. This engine piston design can reduce the manufacturing cost.

According to the present invention, a metal mold assembly for an engine piston comprises outer and inner molds, a cooling oil pipe and a holding member. The outer mold is a mold for determining an outside shape of the piston. The inner mold is for determining an inside shape of the piston. The holding member holds the cooling oil pipe in the mold assembly. The cooling oil pipe comprises an intermediate pipe segment and a first extension extending from the intermediate segment to a first pipe end in a first direction. The holding member is supported by the inner mold, and comprises a first holding pin for supporting the cooling oil pipe by supporting the first extension. The cooling oil pipe may further comprise a second extension extending from the intermediate segment to a second pipe end in the first direction. The holding member may further comprise a second holding pin for holding the second pipe end of the cooling oil pipe in addition to the first holding pin for holding the first pipe end of the cooling oil pipe.

The holding pins are provided in the inner mold, and both pins are detachable and removable in an axial direction of the piston in an illustrated example.

Each of the holding pins of the illustrated example has a cylindrical tip end which can fit in one of the open ends of the cooling oil pipe. The outside diameter of the tip end of each holding pin is slightly smaller than the inside diameter of the pipe of the hollow cylindrical shape so that the tip end is snugly fit in one of the pipe ends. Each holding pin of the illustrated example is a round rod of a predetermined diameter and the tip end is reduced in diameter as compared to the diameter of the round rod. The tip ends of the holding pins close the ends of the cooling oil pipe and prevent molten metal from entering the hollow inside of the pipe.

In the mold assembly of the illustrated example, the intermediate pipe segment is bent in a ring shape, and the holding pins are approximately perpendicular to the intermediate pipe segment.

The first and second extensions can be made short. In this case, the oil pipe does not project from the piston main body, and both ends of the oil pipe open in the piston main body. After the casting operation forming the piston main body including the oil pipe within the final casting, the holding pins are extracted. Thus, there are formed two pipe ends opening in the inner side of the piston main body, and serving as oil inlet and outlet.

DETAILED DESCRIPTION OF THE INVENTION

Figure 1:
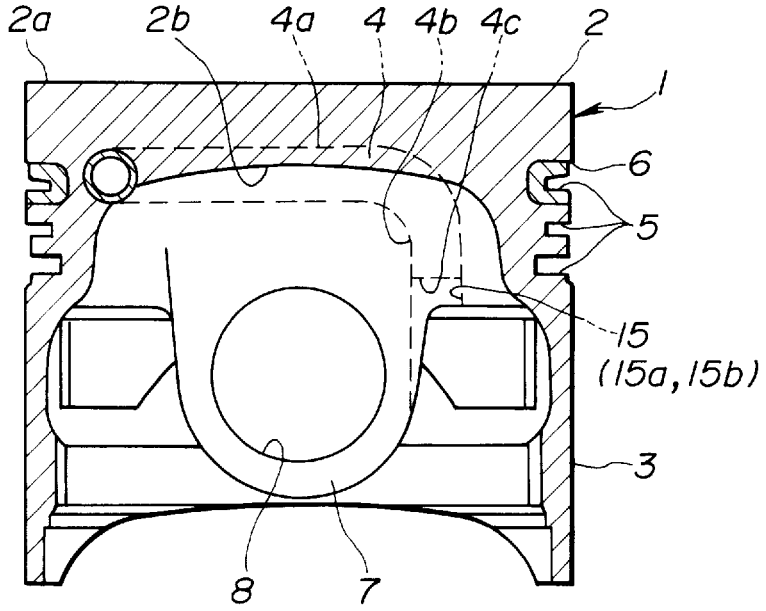
FIG. 1 is a sectional view of an engine piston according to one embodiment of the present invention.

FIG. 1 shows a piston for an internal combustion engine according to one embodiment of the present invention.

The piston shown in FIG. 1 has a body 1, as main component part. The piston main body 1 includes a piton head or crown 2 and a piston skirt 3 at least. The piston further includes an oil gallery 4 embedded in the piston head 2.

The piston head 2 has a top (or upper) side 2*a* defining a combustion chamber and an under (or lower) side 2*b* inside the main body 1. The top and under sides 2*a* and 2*b* are two opposite sides facing in two opposite directions. The piston main body 1 is formed with grooves 5 for receiving piston rings. In this example, the top piston ring groove is formed by a wear resisting member 6 in a groove of the main body 1.

The piston main body 1 is further formed with pin bosses 7 each having a pin hole 8 for receiving a piston pin.

Figure 2:
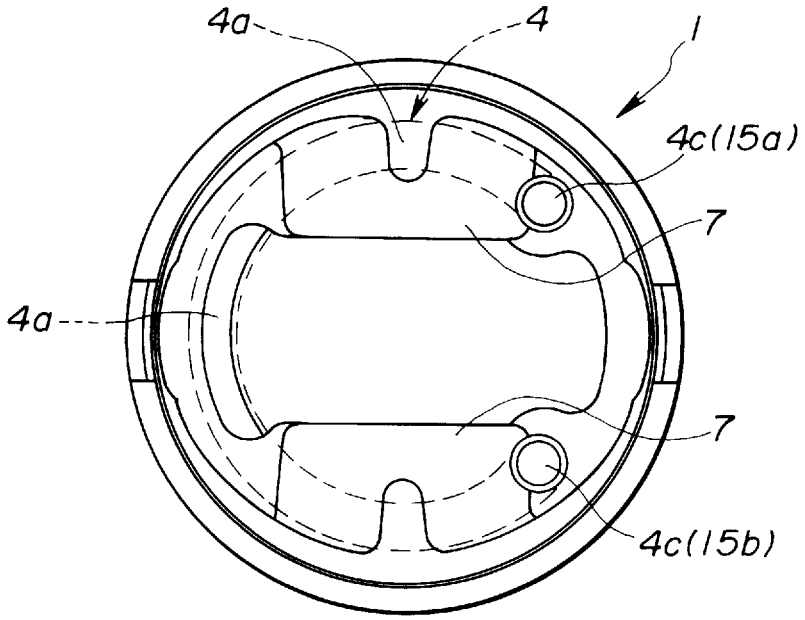
FIG. 2 is a bottom view of the engine piston of FIG. 1.
Figure 3:
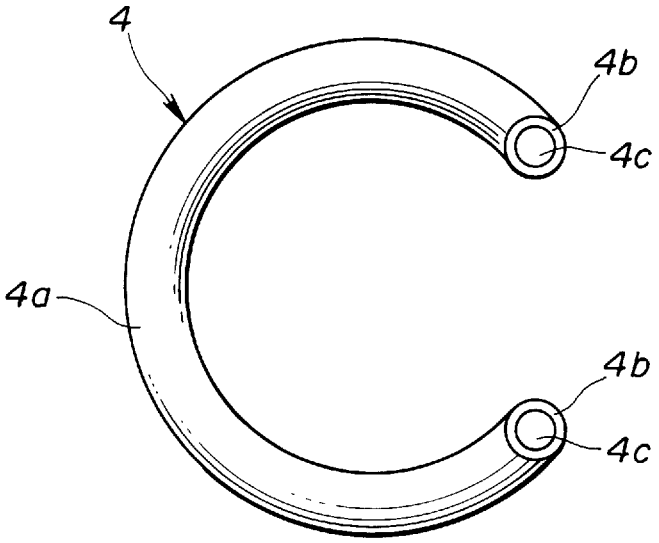
FIG. 3 is a plan view of an oil gallery of the engine piston of FIG. 1.
Figure 4:
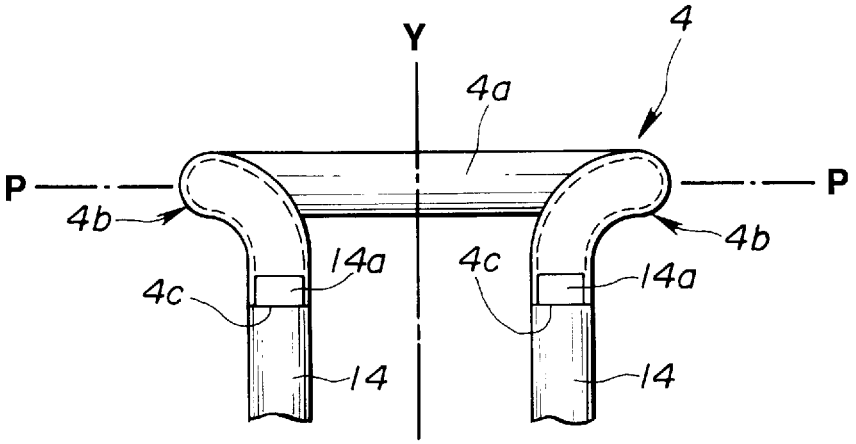
FIG. 4 is a view for showing the oil gallery and holding pins according to the embodiment of FIG. 1.

As shown in FIGS. 3 and 4, the oil gallery 4 is in the form of a pipe having an intermediate pipe segment 4*a* and first and second extensions 4*b* extending from both ends of the intermediate pipe segment 4*a*. The oil gallery pipe (or cooling oil pipe) 4 is made of material having a good thermal conductivity, such as aluminum alloy or copper. The intermediate pipe segment 4*a* of this example is curved like a ring, and the curved centerline of the intermediate pipe segment 4*a* is substantially in the form of an arc of a circle. An axial line Y shown in FIG. 4 is a straight line passing through the center of this circle. The circle lies in a plane P shown in FIG. 4. The axial line Y is perpendicular to the plane P of the circle. The angle subtended at the center by the arc is greater than 180° and smaller than 360° in the example shown in FIGS. 3 and 4. In this example, this angle is approximately equal to 270° as shown in FIGS. 2 and 3.

The first and second extensions 4*b* extend from first and second ends of the circular pipe segment 4*a*, respectively. Each of the extensions 4*b* has a lower end segment that is substantially straight and parallel to the axial line Y. The first and second extensions 4*b* are both located on the same side of the plane P of the intermediate pipe segment 4*a*, and both extensions 4*b* extend from the intermediate segment 4*a* in the same direction away from the plane P. Each of the first and second extension 4*b* is smoothly bent from the intermediate segment 4*a*. Each extension 4*b* has a bent segment extending smoothly and curvedly from one end of the intermediate segment to an upper end of the corresponding lower end segment. In FIG. 4, the first and second extensions 4*b* are symmetrical with respect to the axial line Y so that one is an mirror image of the other. The lower end segments of the first and second extensions 4*b* are parallel to each other. The distance between the parallel segments of the first and second extensions 4*b* is smaller than the diameter of the circle of the intermediate pipe segment 4*a* in the example shown in FIGS. 3 and 4. The intermediate pipe segment 4*a* and the bent segments and straight lower end segments of the first and second extensions 4*b* are all integral parts of the single continuous pipe 4. The oil gallery pipe 4 of this example is in the shape of a hollow circular cylinder, and substantially uniform in diameter form one end to the other.

As shown in FIG. 1, the intermediate pipe segment 4*a* is buried under the topside 2*a* of the piston head 2. In this example, the axial direction Y of the oil gallery pipe 4 coincides with the axis or centerline of the cylindrical piston main body 1, as shown in FIG. 2. The axis or centerline of the piston main body 1 is perpendicular to the plane P of the intermediate pipe segment 4*a*. The intermediate pipe segment 4*a* is at the level of the top ring groove 5 defined by the wear resisting member 6, as shown in FIG. 1. The intermediate pipe segment 4*a* is surrounded by the top ring groove 5. In this example, one extension 4*b* is located on one side of one pin boss 7 (on the right side as viewed in FIG. 2), and the other extension 4*b* is located on the same side of the other pin boss 7.

The piston main body 1 is formed by a casting process, and simultaneously the oil gallery 4 is embedded at least partly in the piston main body 1 by the casting process. After the completion of the casting process, the oil gallery 4 is an integral part of the piston. By the casting process, the oil gallery 4 is buried in the piston head 2, under the upper side 2*a* at such a level that the circular pipe section 4*a* of the oil gallery 4 is concentrically surrounded by the wear resisting member 6 in the top ring groove 5. Inside the piston main body 1, the axis Y of the oil gallery 4 is substantially coincident with the axis of the piston body 1. The straight segments of the first and second extensions 4*b* extend substantially in parallel to the axis of the piston, in the downward direction as viewed in FIG. 1 away from the piston head 2, and open downwards as shown in FIG. 2.

Figure 5:
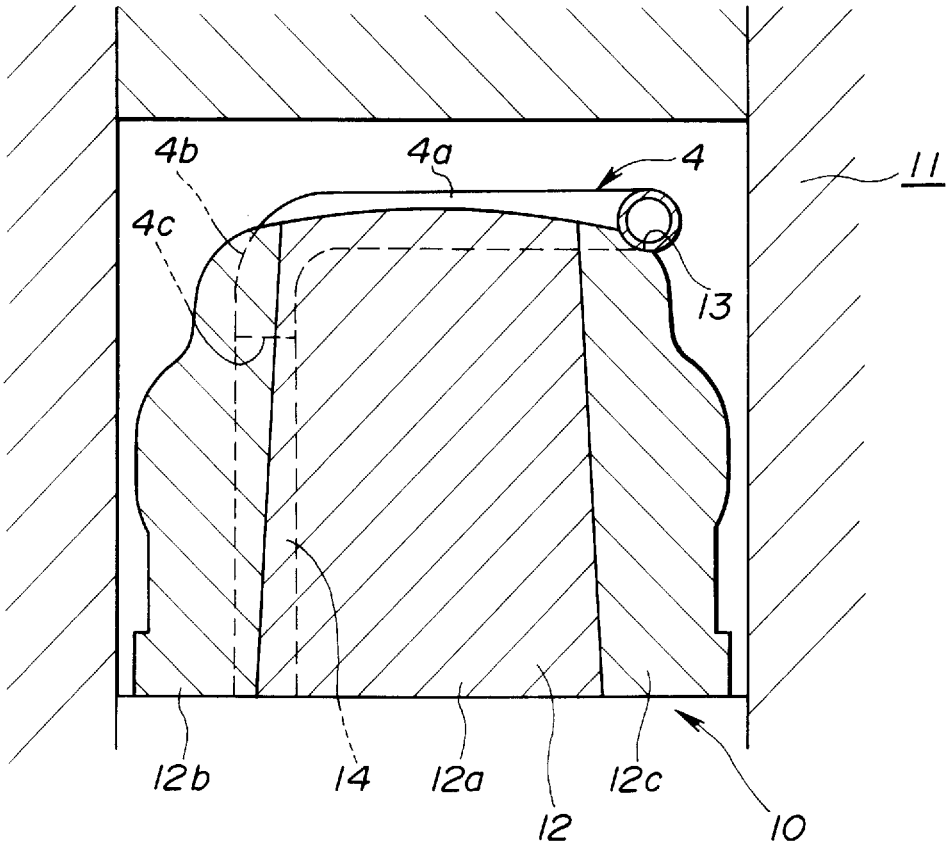
FIG. 5 is a sectional view of a mold assembly for the engine piston of FIG. 1.

FIG. 5 shows a metal mold assembly (or die assembly) for casting the piston having the oil gallery 4 therein.

The mold (or die) assembly comprises an inner mold (or core) 10 for defining the inside circumferential shape of the piston main body 1, and an outer mold 11 for defining the outside circumferential shape of the piston main body 1.

The inner mold 10 of this example includes a central slide member 12 and a pair of movable members for forming the pin bosses 7. The central slide member 12 is placed between the movable members (not shown in FIG. 5).

The central slide member 12 of this example includes a center block 12*a* and first and second side blocks 12*b* and 12*c*. The center block 12*a* is sandwiched between the side blocks 12*b* and 12*c*, as shown in FIG. 5. The side blocks 12*b* and 12*c* are designed to define parts of the inside circumferential surface of the piston main body 1.

Figure 6:
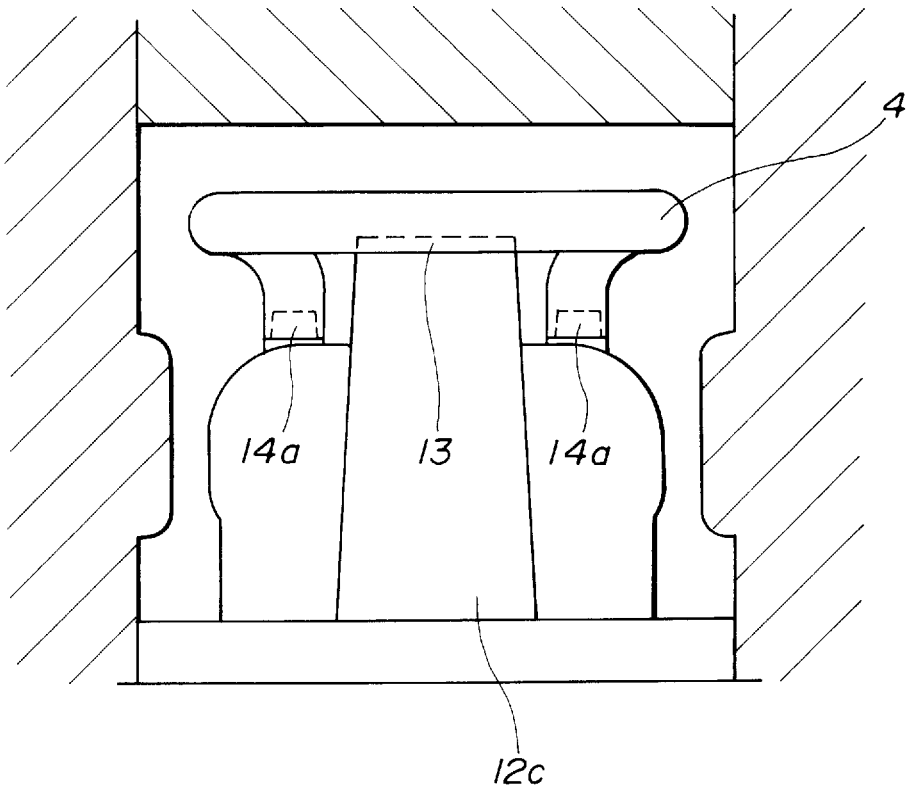
FIG. 6 is a sectional view showing the mold assembly of FIG. 5.

The inner mold 10 of this example is formed with a holding groove 13 for retaining a part of the circular pipe segment 4*a* of the oil gallery 4, as shown in FIGS. 5 and 6. The circular pipe segment 4*a* is fit in the holding groove 13. The groove 13 of this example has an inside surface for fitting over the outside cylindrical surface of the oil gallery pipe 4. In the cross section, the inside surface of the holding groove 13 is in the form of an arc of a circle. The holding groove 13 is formed in the side block 12*c* as shown in FIG. 6.

The mold assembly further includes first and second holding pins 14. The hold pins 14 of this example are straight and substantially parallel to the axis or piston center line of the piston man body 1. The holding pins 14 are provided in the inner mold 10 in a removable and detachable manner.

Each of the holding pins 14 has an upper end formed with a projection 14*a* which, in this example, is cylindrical. On the other hand, each extension 4*b* of the oil gallery pipe 4 has an open end 4*c* opening downward. The projection 14*a* of each holding pin 14 is designed to fit in the circular open end 4*c* of one of the first and second extensions 4*b* of the oil gallery pipe 4. The projection 14*a* of each holding pin 14 has such a diameter as to close one of the open ends 4*c* by fitting therein, and to prevent molten metal from penetrating inside the oil gallery 4 in the casting process. The outside diameter of the holding pins 14 is substantially equal to the outside diameter of the oil gallery pipe 4. The outside diameter of the cylindrical projections 14*a* of the pins 14 is slightly smaller than the inside diameter of the oil gallery pipe 4. Each pin 14 of this example has an annular step surface surrounding the cylindrical projection 14*a* and abutting on the corresponding pipe end 4*c* of the oil gallery pipe 4.

In this example, the holding pins 14 are provided on one side of one of the above-mentioned movable members, and the holding groove 13 is formed on the other side of the other movable member.

The casting process of the piston main body 1 is as follows:

First, the oil gallery pipe 4 is installed in the mold assembly by fitting the open ends 4*c* of the oil gallery 4 over the cylindrical projections 14*a* of the holding pins 14, respectively, and fitting the intermediate pipe segment 4*a* in the holding groove 13.

The thus-formed assembly of the inner mold 10, the oil gallery pipe 4, and the holding pins 14 is then placed in the outer mold 11. Then, the piston main body 1 is formed by casting.

After the completion of casting, the holding pins 14 are extracted from the piston main body 1 formed by the casing, by pulling the holding pins 14 from the ends 4*c* of the oil gallery pipe 4. By this operation, first and second communication oil passages (or holes) 15*a* and 15*b* are formed. The first and second oil passages 15*a* and 15*b* extend rectilinearly, respectively, from the open ends 4*c* of the oil gallery pipe 4 inserted in the casting of the piston main body 1. The first oil passage 15*a* is used as a cooling oil inlet passage, and the second oil passage 15*b* is used as a cooling oil outlet passage. The shapes of the passages 15*a* and 15*b* are determined by the holding pins 14. The first passage 15*a* is straight and in alignment with the straight segment of the first extension 4*b*. The second passage 15*b* is straight and in alignment with the straight segment of the second extension 4*b*.

After the extraction of the holding pins 14 from the piston main body 1, the center block 12*a*, the side blocks 12*b* and 12*c*, and the movable members are removed in order of mention. By this operation of removing the inner mold 10, the holding pins 14 and the outer mold 11, there is formed the integral piston casting of the piston main body 1 and the oil gallery pipe 4 integrally inserted in the piston head 2.

In the piston casting of the piston main body 1 and the oil gallery 4, the piston ring grooves 5 are formed in the circumferential side wall surface of the piston main body 1 between the piston head 2 and skirt 3. Furthermore, the piston pin holes 8 are formed in the pin bosses 7.

This engine piston is inserted in a cylinder of an internal combustion engine, and connected with a crankshaft of the engine through a piston pin inserted through the piston pin holes 8, and a connecting rod. In the engine, the piston converts gas pressure into mechanical movement, and transmits a force to the crankshaft in the form of a driving force.

In the internal combustion engine, the first passage (oil inlet hole) 15*a* leading to one end 4*c* of the oil gallery pipe 4 is directed to a jet hole of an oil jet, and the second passage (oil outlet hole) 15*b* is directed to an oil pan. The jet hole facing the oil inlet passage 15*a* introduces the cooling oil into the oil gallery pipe 4 through the inlet passage 15*a*. The oil circulates in the oil gallery 4 and flows out through the second oil passage 15*b*.

The oil in the oil gallery pipe4 cools the piston head 2 and its vicinity, and prevents overheat of the piston. Thus, the piston can move smoothly in a lubricous state with the cylinder.

In the casting process of this example, the oil gallery pipe 4 is accurately located and firmly retained by the holding pins 14 and the holding groove 13. The casting process therefore requires no additional special members for locating the oil gallery 4 in the inner mold 10. This process can reduce the number of required component parts and reduce the manufacturing cost significantly. The mold assembly of this example can reliably prevent molten metal from entering the oil gallery 4.

In this process, the oil inlet and outlet holes 15*a* and 15*b* are formed by extracting the holding pins 14. This system does not require an additional operation for forming the oil inlet and outlet holes and thereby further reduces the cost.

In this example, the oil gallery 4 is not supported from the outer mold 11. Instead, the oil gallery 4 is located and supported by the inner mold 10. Therefore, the molten metal can flow smoothly without being blocked by holding members.

In the illustrated example, the circular section 4*a* of the oil gallery pipe 4 is not completely embedded in the piston head 2. The circular section 4*a* of the oil gallery pipe 4 is partly exposed from the underside 2*b* of the piston head 2, as shown in FIG. 1.

However, it is possible to completely embed the circular section 4*a* of the oil gallery pipe 4 in the piston main body 1 by the casting process according to the present invention. In this case, the oil gallery 4 is located and supported only by the holding pins 14 (without the holding groove 13) in the mold assembly, and the piston main body 1 is formed by the casting with this mold assembly. The circular section 4*a* of the oil gallery 4 is entirely buried and concealed in the piston head 2, and the appearance of the piston is improved.

In the illustrated example, the extensions 4*b* of the oil gallery 4 are relatively short, and the inlet and outlet holes 15*a* and 15*b* are formed by extracting the holding pins 14. It is possible to make the extensions 4*b* of the oil gallery pipe 4 longer and instead to make the holes 15*a* and 15*b* shorter or eliminates the holes 15*a* and 15*b*.

Oppositely, it is possible to make the extensions 4*b* shorter. In this case, the pipe ends 4*c* of the oil gallery pipe open in the piston main body 1 without projecting from the main body 1.

In this way, this casting process and the piston configuration can facilitate the piston fabricating operations and reduce the manufacturing cost considerably.

What is claimed is:

1. An engine piston comprising:

a main body comprising a piston head comprising a top surface; and a cooling oil pipe which is inserted in the piston head of the main body;

wherein the cooling oil pipe comprises an intermediate pipe segment and first and second extensions extending from the intermediate segment in a downward direction away from the top surface.

2. An engine piston according to claim 1 wherein the intermediate segment is buried under the top surface and extends from a first segment end to a second segment end along the top surface; the first extension extends from the first end of the intermediate segment and the second extension extends from the second end of the intermediate segment, each of the first and second extensions comprises a straight end segment having an open end, the straight segments of the first and second extensions are substantially parallel to an axis of the main body.

3. An engine piston according to claim 2 wherein the intermediate segment extends curvedly in a plane to which the axis of the main body is perpendicular, and the straight segments of the first and second extensions are perpendicular to the plane.

4. An engine piston according to claim 3 wherein the intermediate segment is annular, and extends around the axis of the main body.

5. An engine piston according to claim 3 wherein the intermediate segment is in a form of an arc of a circle around the axis of the main body in the plane perpendicular to the axis of the main body, and the first and second extensions project from the piston head in the downward direction away from the top surface of the piston.

6. An engine piston according to claim 3 wherein the intermediate segment has a center line in a form of an arc of a circle in the plane perpendicular to the axis of the main body, the center of the circle is coincident with the axis of the main body, an angle subtended at the center by the arc is greater than 180° and smaller than 360°, and a distance between the straight segments of the first and second extensions is smaller than a diameter of the circle.

7. An engine piston according to claim 3 wherein the first extension comprises a bent segment extends curvedly from the first segment end of the intermediate segment to the straight segment of the first extension, the second extension comprises a bent segment extends curvedly from the second segment end of the intermediate segment to the straight segment of the first extension, and each of the intermediate segment and the straight segments and bent segments of the first and second extensions is an integral part of the oil cooling pipe, and wherein the main body is formed with a piston ring groove, and the intermediate segment is surrounded by the piston ring groove in the plane.

8. An engine piston according to claim 3 wherein the main body is a metal casting, and the cooling pipe is a metal pipe which is integral with the metal casting.

9. An engine piston according to claim 3 wherein the intermediate segment of the cooling oil pipe comprises an upper portion embedded in an underside of the piston head and a lower portion bared from the underside of the piston head.

10. An engine piston comprising:

a main body comprising a piston head defining a top surface of the piston; and a cooling oil pipe extending under the top surface in the piston head of the main body;

wherein the cooling oil pipe extends from a first pipe end to a second pipe end, and the first and second pipe ends both open in a downward direction away from the top surface.

11. An engine piston according to claim 10 wherein the main body comprises a first straight oil passage extending from the first pipe end in the downward direction, and a second straight oil passage extending from the second pipe end in the downward direction.

* * * * *

UNITED STATES PATENT AND TRADEMARK OFFICE

CERTIFICATE OF CORRECTION

PATENT NO. : 5,771,776
DATED : June 30, 1998
INVENTOR(S) : Hideki ITOH

It is certified that error appears in the above-identified patent and that said Letters Patent is hereby corrected as shown below:

On the title page, insert the following:

[30] Foreign Application Priority Data

April 22, 1996 [JP] Japan.....8-122798

Signed and Sealed this

Twenty-seventh Day of July, 1999

*Attest:*

*Attesting Officer*

Q. TODD DICKINSON

*Acting Commissioner of Patents and Trademarks*